United States Patent [19]

Hsieh

[11] 4,358,771

[45] Nov. 9, 1982

[54] POWER DISTRIBUTION TYPE ANTENNA

[75] Inventor: Kou-Chang Hsieh, Yonezawa, Japan

[73] Assignee: Yamagata University, Yamagata, Japan

[21] Appl. No.: 249,237

[22] Filed: Mar. 30, 1981

[30] Foreign Application Priority Data

Apr. 9, 1980 [JP] Japan ..... 55-45695

[51] Int. Cl.[3] ..... H01Q 3/26

[52] U.S. Cl. ..... 343/854; 343/911 R; 343/754

[58] Field of Search ..... 343/854, 909, 911 R, 343/911 L, 756, 840, 755

[56] References Cited

U.S. PATENT DOCUMENTS 3,763,493 10/1973 Shimada et al. ..... 343/837
3,990,080 11/1976 Lundgren, Jr. ..... 343/756
4,129,872 12/1978 Toman ..... 343/840

*Primary Examiner*—David K. Moore
*Attorney, Agent, or Firm*—Spencer & Kaye

[57] ABSTRACT

A number of planar diplexers which intersect a beam radiated from a primary projector at respectively predetermined angles, which are separated from the projector and from each other, are provided with respectively predetermined conductor patterns. The diplexers are arranged successively in a frame together with the primary projector, whereby various radiation patterns can be formed by different combinations of a number of beams which are reflected respectively by the planar diplexers at respectively predetermined rates. As a result, a power distribution type antenna having a small and simple structure adapted for multipurpose and multifunction applications, particularly for installation on a communication satellite, based on the portability and the ease of assembling thereof, can be realized.

13 Claims, 13 Drawing Figures

POWER DISTRIBUTION TYPE ANTENNA

BACKGROUND OF THE INVENTION (1) Field of the Invention

The present invention relates to a power distribution type antenna for radiating a number of beams consisting of an electromagnetic-wave, for instance, a microwave, which are formed by distributing high frequency electric power radiated from a primary projector. In particular, the invention relates to an antenna having a small and simple structure which is adapted for multipurpose and multifunction uses.

(2) Description of the Prior Art

Generally speaking, for the power distribution type antenna mentioned above, various kinds of antennas having different functions are employed for various purposes, such as a multibeam antenna having a primary projector supplied with electric power of a single frequency and antennas selected from a group consisting of a multi-frequency multibeam antenna, multi-polarized multibeam antenna, variable multibeam antenna and combinations thereof, in which group a primary projector is supplied with multi-frequency or multi-polarity electric power. Moreover, it is frequently required to provide such an antenna which additionally functions as a spot beam antenna or shaped beam antenna in which a primary projector is supplied with electric power having a single frequency, multi-frequency or multi-polarity.

The above mentioned conventional antennas of this kind have different structures adapted respectively for the above mentioned various purposes or functions, so that any one of those conventional antennas has no more than at most a few of these various functions. Accordingly, it is required even for use in a similar frequency range to newly design and to newly manufacture an antenna having a new structure which is quite different from those of conventional antennas according to its new purpose. As a result, complications are caused in manufacturing the newly designed antenna as well as in transporting and installing it since the skills involved in conveyance and installation are quite different from those for conventional antennas. Furthermore, most conventional antennas of this kind are relatively large, so that finding the space for their installation is a troublesome problem, particularly when they are mounted on a communication satellite.

SUMMARY OF THE INVENTION

An object of the present invention is to provide a power distribution type antenna having a simple structure adapted particularly for mounting on a communication satellite, for which the above mentioned troublesome problems are entirely solved, which is provided with various functions adapted for multipurpose by substantially similar structures, and which is suitable for simple and easy conveyance and installation, particulary, in cosmic space.

Another object of the present invention is to provide a small and light spot beam antenna which permits simple and easy conveyance and installation in cosmic space in particular.

Still another object of the present invention is to provide a small and light shaped beam antenna which permits simple and easy conveyance and installation in cosmic space in particular.

A further object of the present invention is to provide a small and light multibeam antenna which permits simple and easy conveyance and installation in cosmic space in particular.

A still further object of the present invention is to provide a small and light multi-frequency or multi-polarized multibeam antenna which permits simple and easy conveyance and installation in cosmic space in particular.

Yet another object of the present invention is to provide a small and light variable multibeam antenna which permits simple and easy conveyance and installation in cosmic space in particular.

Yet a further object of the present invention is to provide a small and light power distribution type antenna provided with various functions by combining the above mentioned various kinds of antennas.

A feature of the present invention is that a number of planar diplexers (metric-grid quasi-optical diplexers), which intersect a beam radiated from a primary projector at respectively predetermined angles apart from each other and on which respectively predetermined conductor patterns are provided, are arranged successively in a frame together with a primary projector, whereby various radiation patterns can be formed by the variation of a combination of a number of beams which are reflected respectively by those planar diplexers at respectively predetermined rates.

BRIEF DESCRIPTION OF THE DRAWINGS

The present invention will be explained in detail hereinafter regarding the preferable embodiments thereof by referring to the accompanying drawings.

DESCRIPTION OF THE PREFERRED EMBODIMENTS

First, the basic structure of a power distribution type antenna according to the present invention will be explained by referring to FIG. 1.

Figure 1:
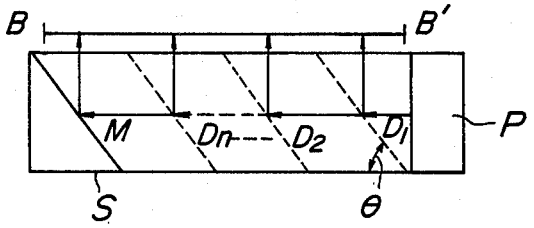
FIG. 1 is a side view showing schematically the basic structure of a power distribution type antenna according to the present invention.

In the basic structure shown in FIG. 1, a beam of an electro-magnetic wave having at least one desired frequency or at least one desired polarity in the microwave or millimeter wave range is radiated from a primary projector P, for which various kinds of conventional well-known antennas can be employed. Plural planar diplexers $D_1, D_2, \ldots, D_n$, which cross over an axis of the electro-magnetic beam at respective desired angles $\theta$ are arranged in order apart from each other and from the primary projector P at appropriate respective distances. Further, at an end of the arrangement of planar diplexers, a flat metallic plate M, which crosses over the axis of the electro-magnetic beam at the desired angle $\theta$, a similar manner to the planar diplexers, is arranged apart from the immediately preceding planar diplexer $D_n$ at an appropriate distance. All of the primary projector P, the diplexer $D_1, D_2, \ldots, D_n$ and the metallic plate M are mounted on a supporting frame S so as to be fixed or movable as occasion demands.

Figure 2A:
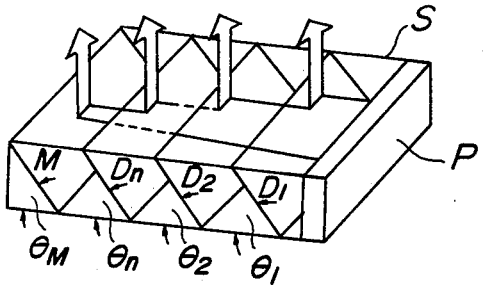
FIGS. 2*a* and 2*b* are perspective and side views showing respectively an embodiment of a spot beam antenna according to the present invention.
Figure 2B:
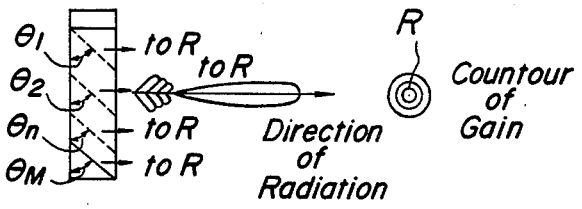

An example of the basic operation of the power distribution type antenna having the above mentioned structure according to the present invention will be described by referring to FIGS. 2*a* and 2*b*. In the antenna shown schematically in FIG. 2*a*, plural planar diplexers $D_1, D_2, \ldots, D_n$, each of which is formed of a number of conductor pieces having a suitable shape adequately sized for operating as an antenna element and, for instance, being deposited on a dielectric base as described later, are arranged in the direction of an electromagnetic-wave beam radiated from a primary projector P, so as to intersect an axis thereof at angles $\theta_1, \theta_2, \ldots, \theta_n$ respectively. Further, and further a metallic plate M is arranged at an end of the row of diplexers, so as to intersect the above axis of the electromagnetic-wave beam at an angle $\theta_M$, all of those elements being fixedly mounted on a supporting frame S. Accordingly, when the electromagnetic-wave beam radiated from the primary projector P reaches any one of the diplexers $D_1, D_2, \ldots, D_n$, a component thereof having a frequency resonating to the array of antenna elements formed of the conductor pieces on the pertinent diplexer is reflected by the pertinent planar diplexer while the remaining components thereof pass therethrough successively as shown in FIG. 2*a*, a least the remaining components reaching the metallic plate M being entirely reflected thereby. The frequencies and the reflection rates of those components reflected respectively by each of the diplexers are decided by the shapes and the sizes of the antenna element arrays formed thereon respectively, and the directions of the electromagnetic-wave beams consisting of those components reflected respectively by the diplexers $D_1, D_2, \ldots, D_n$ and the metallic plate M are decided respectively by the angles $\theta_1, \theta_2, \ldots, \theta_n$ and $\theta_M$ subtended between each of those planar elements and the axis of the electromagnetic-wave beam radiated from the primary projector P.

As a result thereof, under the condition that the shapes and the sizes of the antenna element arrays formed on the diplexers and the angles at which the diplexers and the metallic plate are set is appropriate, it is possible to readily manufacture a number of small and light power distribution type antennas having various structures which are similar to each other and which are adapted for various kinds of multipurpose functions.

For example, the mounting angles $\theta_1, \theta_2, \ldots, \theta_n$ and $\theta_M$ of the diplexers $D_1, D_2, \ldots, D_n$ and the metallic plate M may be set to approximately the same valve so as to intersect the electromagnetic beam radiated from the primary projector P in parallel with respect to each other, and the primary projector P may be fed with an electromagnetic wave having a single frequency.

In the above mentioned situation where all of the reflected electromagnetic-wave beams are directed approximately in the same direction, when all of those reflected electromagnetic-wave beams having the same single frequency are regulated to be co-phasal with each other at an opening plane B-B' shown in FIG. 1, a single narrow electromagnetic-wave beam is formed by combining those co-frequency and co-phase reflected electromagnetic-wave beams. Under the condition that the above mentioned structure is employed, it is possible to obtain an extremely narrow half power beamwidth (HPBW) of the single electromagnetic beam formed by combining the reflected beams from n diplexers which is substantially equal to $1/(n+1)$ of that of the electromagnetic-wave beam radiated from the primary projector P. It is also possible to increase the antenna gain therefor which is proportional to the opening area of the antenna to approximately $(n+1)$ times that of the primary projector P, whereby it is possible to realize a small and light spot beam antenna having a simple structure which radiates an extremely narrow spot beam.

However, the above mentioned spot beam antenna is not reversible, that is, so long as all of the same frequency beams reflected by the diplexers and the metallic plate are not co-phasal at the opening plane B-B', the above mentioned effects of the combination of the reflected beams cannot be obtained, so that, the antenna gain obtained by employing the above described spot beam antenna as a receiving antenna is no more than that of the primary projector P.

Next, as for the primary projector P used for the power distribution type antenna according to the present invention, it is possible to employ any one of a number of well-known conventional antennas for radiating electromagnetic-wave beams in various manners, for instance, an electromagnetic horn, a combination of an electromagnetic horn and a parabolical reflector, a slot antenna array and others depending upon the application.

On the other hand, as for the diplexer used for the power distribution type antenna according to the present invention, whatever configuration functions as a selective reflector for the electromagnetic-wave beam radiated from the primary projector P such as mentioned earlier regarding the basic operation of the antenna according to the present invention can be employed regardless of the structure thereof.

However, it is preferable for facilitating the arbitrary change of frequency, polarity and other parameters of the electromagnetic beam radiated from the primary projector P of the antenna according to the present invention and the arbitrary setting of the frequency range, reflection rate and other parameters of the electromagnetic reflection effected by the diplexers to employ a planar diplexer described as follows.

Figure 3:
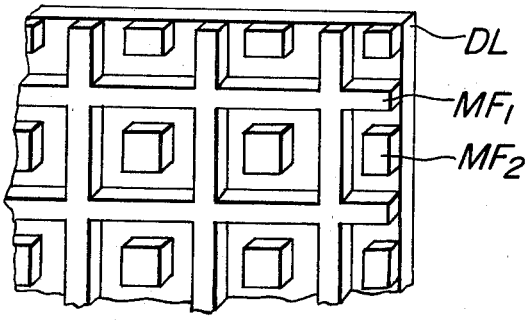
FIG. 3 is a perspective view showing a part of an embodiment of a planar diplexer employed for a power distribution type antenna according to the present invention.

The above mentioned planar diplexer, a part of which is shown in FIG. 3, is formed by deposting a lattice-shaped metallic film $MF_1$ on an entire surface of a dielectric base DL, the thickness of which film is selected in a range between scores and hundreds of microns so as to only slightly effect an electromagnetic wave in the pertinent frequency range. A number of blocks of metallic films $MF_2$ having substantially the same thickness as that of the metallic film $MF_1$ and are further deposited on the base DL within, for instance, nearly square lattice windows formed by the lattice-shaped metallic film $MF_1$. The size of the lattice windows and the width of the metallic portions of the lattice-shaped metallic film $MF_1$ and the shape and the size of the blocks of metallic film $MF_2$ are selected in accordance with the frequency range and reflection rate of the electromagnetic reflection in response to the particular use for the antenna and to facilitate the installation thereof on the supporting frame S in the most suitable position corresponding to its intended use.

More specifically, the above mentioned planar diplexer has been configured to obtain a diplexer whose design and analysis is simple, so as to easily obtain an extremely sharp frequency band, and; as a result, effect a remarkable improvement in the the identification of polarized waves and the branching of microwaves, millimeter waves and the like on an antenna.

Moreover, in the situation where, in the lattice windows of the above mentioned lattice-shaped metallic film $MF_1$, blocks of the metallic film $MF_2$ having the shape of a square frame, a double square frame, a modification thereof adapted for self-supporting and the like are deposited, and besides, the lattice pitch and the ratio between respective areas of the metallic portion and the space of the lattice-shaped metallic film $MF_1$ and the length of the block of the inserted metallic film $MF_2$ and further the ratio between respective areas of those metallic films $MF_1$ and $MF_2$ and others are selected appropriately, it is possible arbitrarily to set the resonant frequency, the fractional resonant frequency bandwidth, the sharpness of performance thereof and the like at respectively desired values. It is also possible to suitably select the frequency band and the reflection rate of the electromagnetic-wave beam reflected by the above mentioned planar diplexer.

Figure 4A:
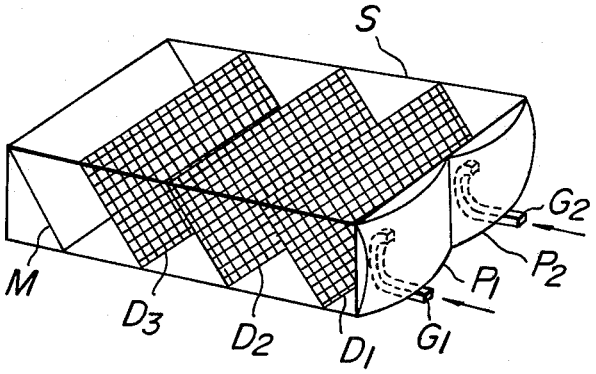
FIGS. 4*a* and 4*b* are perspective views showing respectively other embodiments of a spot beam antenna according to the present invention.
Figure 4B:
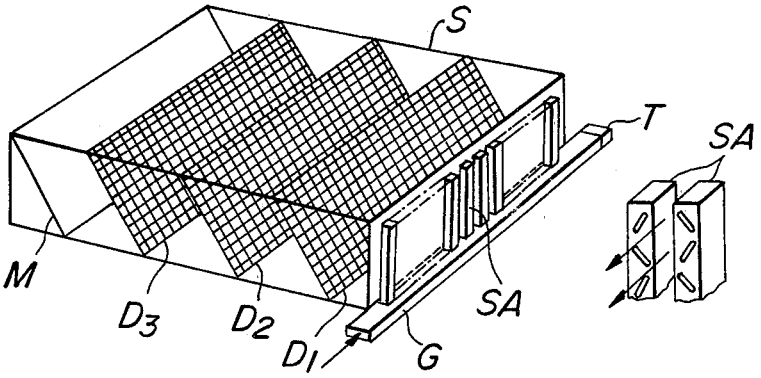

Examples of the detailed structure of the spot beam antenna as shown in FIG. 2*a*, which comprises the above mentioned planar diplexers as the most suitable for the antenna of the present invention, are shown in FIGS. 4*a* and 4*b* respectively. In both of those examples, the diplexers $D_1$, $D_2$ and $D_3$ consisting of the spot beam antenna shown in FIG. 2*a* are formed respectively of that shown in FIG. 3, and besides, in the example shown in FIG. 4*a*, the primary projector P is formed of the parallel arrangement of two parabolic projectors consisting respectively of the combinations of electromagnetic horns $G_1$ and $G_2$ and parabolic reflectors $P_1$ and $P_2$. In the example shown in FIG. 4*b*, the primary projector P is formed of a number of slot antenna arrays SA which are arranged at right angles with the direction of the beams radiated therefrom, so as to obtain, for instance, an extremely sharp circular-polarized spot beam. Each of those spot beam antenna arrays SA consists of a number of slots which are formed on a wall of a rectangular waveguide coupled with another rectangular waveguide G terminated with a terminator T, in directions such that they are each alternately at right angles, as shown in the enlarged drawing comprising FIG. 4*b* and which are fed respectively with electromagnetic waves having suitable phase differences between each other, so as to form a circularly polarized electromagnetic-wave beam.

Additionally speaking, in other situations than that of the above mentioned spot beam antenna, where the antenna of the present invention is employed for attaining various functions of various kinds of antennas as described later, it is possible pertinently to select various types of projectors other than those mentioned above for the primary projector P of the antenna according to the present invention.

In the situation where the power distribution type antenna of the present invention is used as the spot beam antennas having the above mentioned structures, the following remarkable effects can be obtained.

(1) A high gain spot beam antenna can be realized without the use of a large parabolic reflector of the kind which requires a precisely formed curved surface having a complicated shape such as a parabolic or Cassegrain antenna, and which are frequently employed as spot beam antennas. Consequently, the mechanical design configuration, manufacturing, shipment, installation and other factors, which are troublesome problems for high-gain and large-sized conventional spot beam antennas, can be carried out much more easily than usual.

(2) The size of the antenna required for the same high gain can be greatly reduced in comparison with the conventional parabolic antenna and the like. For example, the depth of the antenna of the present invention, which comprises five or six stages of planar diplexers having an opening area corresponding to that of a parabolic antenna having an opening angle of 150 degrees is equal to about one half the depth of the parabolic antenna.

(3) Any desired radiation power distribution can be easily attained by appropriately selecting the respective shapes and respective sizes of plural planar diplexers arranged in order, so as to set suitable frequency ranges and suitable rates of reflection.

As mentioned earlier, the power distribution type antenna according to the present invention can be provided with various multipurpose functions depending the respective mounting angles of the successively arranged planar diplexers and the metallic plate and the shape and size of the antenna element arrays comprising the planar diplexers, so that staple kinds of antennas provided with those various functions can be enumerated as follows.

(a) Antennas comprising a primary projector fed at a single frequency:
  (i) Spot beam antenna
  (ii) Shaped beam antenna
  (iii) Multibeam antenna
(b) Antennas comprising a primary projector having multi-frequency and multi-polarity feed:
  (iv) Multi-frequency and multi-polarized multibeam antenna
  (v) Variable multibeam antenna
  (vi) Various combinations of the aforesaid antennas Among the various kinds of antennas provided with various functions which are different from each other as mentioned above, regarding the antenna functioning as the spot beam antenna fed at the single frequency, two examples thereof have been explained by referring to FIGS. 2*a*, 2*b*, 4*a* and 4*b*, so that respective examples of the remaining kinds of antennas will be explained hereinafter in order by referring to FIGS. 5*a* to 9.

Figure 5A:
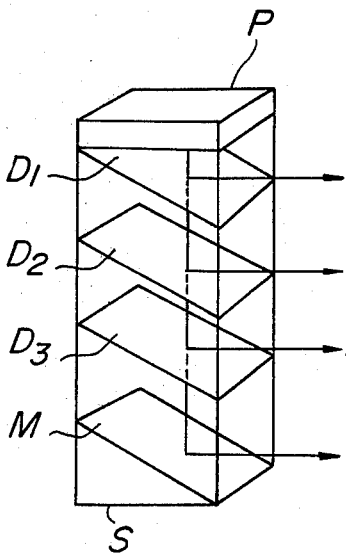
FIGS. 5*a* and 5*b* are a perspective view and a contour map showing respectively an embodiment and an example of a reformed beam pattern of a shaped beam antenna according to the present invention.
Figure 5B:
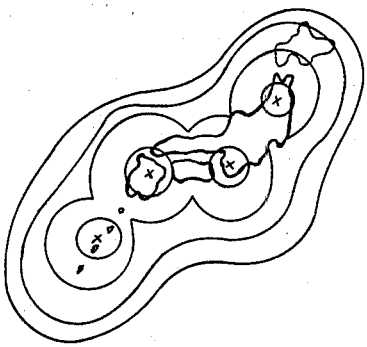

First, an embodiment of the antenna of the present invention, which functions as a shaped beam antenna comprising a primary projector fed at a single frequency, is shown in FIG. 5*a*, an example of a shaped beam pattern thereof being shown in FIG. 5*b*.

For example, it is required for the shaped beam antenna mounted on a satellite used for communication, broadcasting and the like to reform the radiation pattern to a desired beam pattern adapted for efficiently radiating an electromagnetic wave in response to the shape of a service area thereof, so as to obtain, for instance, the beam pattern covering the whole land of Japan as shown in FIG. 5*b*. In the situation where the antenna of the present invention is used for the same shaped beam antenna, for instance, as shown in FIG. 5*a*, the mounting angles of the diplexers $D_1$, $D_2$, $D_3$ and the metallic plate M are set in such a manner that the respective axes of the beams reflected therefrom are directed to midpoints of the predetermined service areas respectively. Also, the shape and size of the antenna element arrays arranged respectively on those diplexers are selected in such a manner that the respective power distribution rates of the beams reflected thereby, which rates are dependent respectively on the reflection rates of the electromagnetic-wave beam reflected thereby, are adapted respectively for the ratios of the substantially circular-shaped service areas centers which correspond to the above mentioned midpoints respectively.

In the above situation of the shaped beam according to the present invention, the following remarkable effects can be obtained.

(1) As conventional shaped beam antennas, for instance, a shaped beam horn reflector antenna in which a radiated beam is reformed according to the relation between wave surfaces at an opening thereof and a shaped beam parabolic antenna in which a radiated beam is shaped according to the opening shape of a primary projector combined with a parabolic reflector are well known. However, regarding the former, in which the reformation of the radiated beam is based on the formation of the surface of the parabolic reflector, a complicated calculation is required for designing the surface of the reflector. Also, it is extremely difficult to accurately manufacture a reflector having the complicated curved shape required. On the other hand, regarding the latter, in which the space surrounding the focus of the parabolic reflector, which space is adapted for reforming the radiated beam by arranging openings of plural primary projectors, is restricted within a narrow range, great difficulty based on the restriction on the number and the opening areas of those primary projectors used for reforming the radiated beam is encountered in realizing the desired shaped beam pattern.

On the contrary, regarding the aforesaid reformed beam antenna according to the present invention, much greater freedom than that mentioned above is obtained for the selection of the number, shape, size, power distribution rate and other characteristics of the plural diplexers arranged in order, so that the designing and manufacturing thereof is greatly facilitated in comparison with design of the usual antenna of this antenna.

(2) The constitution and the combination of constituents of the shaped beam antenna are simplified remarkably, and, as a result, a small and light reformed beam antenna can be realized, so that, the manufacturing, conveyance and installation thereof are greatly facilitated.

Figure 6A:
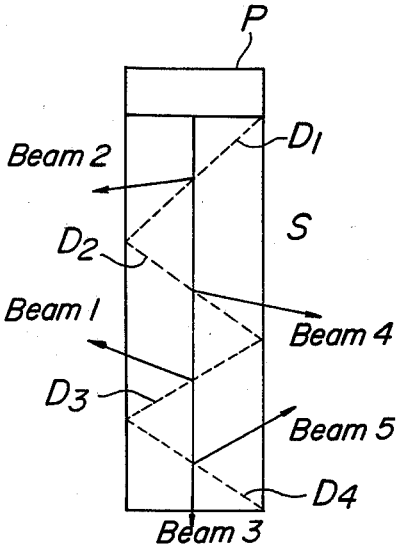
FIGS. 6*a* and 6*b* are a side view and a diagram showing respectively an embodiment and an example of a multibeam pattern of a multibeam antenna according to the present invention.
Figure 6B:
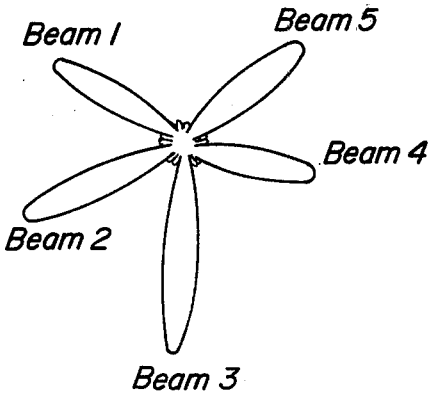

Next, an embodiment of the antenna of the present invention, which functions as a multibeam antenna comprising a primary projector fed at a single frequency, is shown in FIG. 6*a*, an example of a multibeam pattern thereof being shown in FIG. 6*b*.

For example, the respective mounting angles of the plural planar diplexers $D_1$, $D_2$, $D_3$ and $D_4$ arranged in order and respectively intersecting the electromagnetic-wave beam radiated from the primary projector P, which angles are subtended between those diplexers and the axis of the same radiated beam are selected respectively different from each other as shown in FIG. 6*a*, so as to distribute respective beams 2, 4, 1 and 5 reflected respectively by those diplexers $D_1$, $D_2$ and $D_4$ and a beam 3 passing straight through all of those diplexers substantially in all directions.

In the above situation of the multibeam antenna according to the present invention, the following remarkable effects can be obtained.

(1) The structure of the above multibeam antenna is simplified considerably in comparison with that of the conventional multibeam antenna of, for instance, the array type, so that a small and light multibeam antenna can be realized.

(2) The number and the respective powers of the multibeam can be extremely simply and easily selected to meet requirements by properly designing the respective shapes and the respective sizes of the plural diplexers.

(3) A multibeam antenna adapted for installing on a satellite as a three-dimensional multi-direction multibeam antenna and covering a service area which is much wider than usual can be realized by appropriately setting the respective mounting angles of the plural diplexers.

(4) The above multibeam antenna adapted for use in cosmic space is also suitable for multi-directional communication on the ground.

Figure 7:
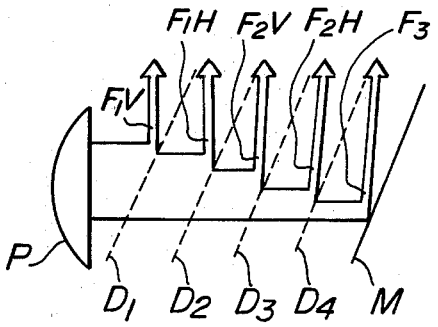
FIG. 7 is a side view showing schematically an embodiment of a multi-frequency of multi-polarized multibeam antenna according to the present invention.

Next, an embodiment of the antenna of the present invention, which functions as a multibeam antenna comprising a primary projector having a multi-frequency and multi-polarity feed is shown in FIG. 7.

In an effort to obtain economy and efficiency in antennas used in the micro-wave and millimeter wave frequency ranges and the effective utilization of frequency bands, various kinds of antennas having multi-frequency and multi-polarity feeds have already been developed. However, these conventional multi-frequency and multi-polarity fed antennas only radiate a single electromagnetic-wave beam consisting of multi-frequency and multi-polarity components.

In contrast, in the situation where the above mentioned conventional multi-frequency and multi-polarity antenna is replaced with an antenna according to the present invention such as shown schematically in FIG. 7 a multi-frequency antenna. More specifically, power distribution type antenna shown in FIG. 7 consists of a primary projector P, plural planar diplexers $D_1$, $D_2$, $D_3$, $D_4$ and a metallic plate M. A beam $F_1V$ is reflected by the diplexer $D_1$ which is vertically polarized in a frequency band $F_1$, a beam $F_2V$ is reflected by the diplexer $D_3$ which is vertically polarized in a frequency band $F_2$, a beam $F_1H$ is reflected by the diplexer $D_2$ which is horizontally polarized in the frequency band $F_1$, a beam $F_2H$ is reflected by the diplexer $D_4$ which is horizontally polarized in the frequency band $F_2$, and the remaining beam $F_3$ is reflected by the metallic plate M which is vertically, horizontally or circularly polarized. A multiplexer can be formed by combining planar diplexers $D_1$, $D_2$, $D_3$ and $D_4$, the shapes and the sizes of the respective antenna element arrays being selected in such a manner that those diplexers reflect respectively only electromagnetic-waves having a specified frequency band and specified polarity.

With the multi-frequency and multi-polarity multibeam antenna according to the present invention, the following remarkable effects can be obtained.

(1) A number of multi-frequency and multi-polarity antennas, which are required conventionally to be operated in parallel for radiating a number of multi-frequency and multi-polarity beams, can be replaced with the above single-structure antenna according to the present invention, so that in the situation where such a multi-frequency and multi-polarity antenna is required to be installed, for instance, on a communication satellite, the occupancy rate of the space restricted for the orbit of the satellite can be reduced considerably in comparison with the usual amount of space required.

(2) All components other than the conventional multi-frequency and multi-polarity antenna employed for the primary projector of the antenna according to the present invention can be formed of the aforesaid planar diplexers or the metallic plate, so that conveyance of the above small and light multi-frequency and multi-polarity antenna is facilitated by being accommodated in a narrow space in the conveyor rocket in an easily and simply folded state.

(3) The above multi-frequency and multi-polarity antenna of the present invention is formed of plural planar diplexers as principal elements, so that the identification rate for cross polarization can be greatly improved in comparison with the usual antenna.

(4) In the situation where plural planar diplexers arranged in order are mounted on an X-Y mount or a polar mount, the directions of the respective beams comprising the multibeam can be simply and easily controlled.

(5) It is also possible to form a circularly polarized reflected beam by utilizing a metallic plate in the last stage.

Figure 8:
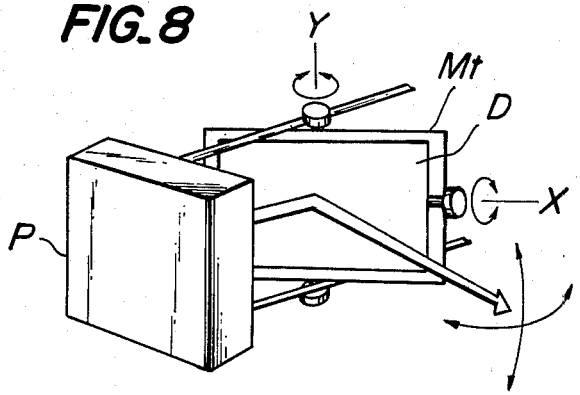
FIG. 8 is a perspective view showing an embodiment of a variable multibeam antenna according to the present invention.

Next, an embodiment of the antenna of the present invention, which functions as the variable multibeam antenna comprising a primary projector having a multi-frequency and multi-polarity feed is shown in FIG. 8.

In the situation where the plural diplexers comprising the multibeam antenna shown in FIGS. 6*a* and 7 installed on a rotatable mount such as the so-called $A_Z$-$E_L$ mount, a X-Y mount, a polar mount or the like, it is possible mechanically to shift the directions of the respective beams comprising the multibeam so as to effect individual scanning or pursuing by those respective beams as shown in the perspective view of FIG. 8 which shows the situation where the $A_Z$-$E_L$ mount is employed. In this situation, a single diplexer D is mounted on a direction controllable $A_Z$-$E_L$ mount $M_t$, which can be rotated respectively about X and Y rotation axes. A principal part of an electromagnetic beam radiated from a primary projector P can be reflected by the rotatable diplexer D in any desired direction, and a remaining part of the same radiated beam can be directed straight toward another diplexer (not shown) regardless of the direction of the rotatable mount $M_t$.

Figure 9:
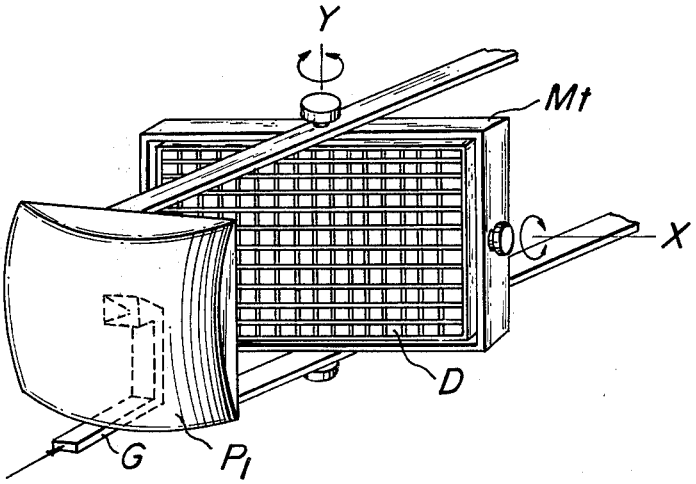
FIG. 9 is a perspective view showing another embodiment of the variable multibeam antenna according to the present invention.

A more practical embodiment of the above mentioned variable multibeam antenna according to the present invention, in which a combination of an electromagnetic horn formed of a waveguide G and a parabolic reflector $P_1$ is employed as the primary projector P and a planar diplexer such as shown in FIG. 3 is employed as the single diplexer D, is shown in FIG. 9, the function thereof being the same as that of the embodiment shown in FIG. 8.

With the above variable multibeam antenna according to the present invention, the following remarkable effects can be obtained.

(1) The direction controllable mount is loaded only by one or more light planar diplexers, so that it is possible easily to provide a pursuing antenna for installing on a satellite in which each of plural multi-frequency and multi-polarity variable beams comprising in a multibeam can be shifted individually.

(2) Based on the above item (1), the above variable multibeam antenna according to the present invention is extremely effective for communication between plural satellites, the establishment of which is the most urgent in the field of communication techniques.

(3) In addition thereto, the above variable multibeam antenna according to the present invention is extremely effective also for the constitution of a communication network including plural communication satellites in the future.

As is apparent from the explanation above, the power distribution type antenna according to the present invention can be employed for various functions which are different from each other, and also for easily realizing a multipurpose and multifunctional antenna having further different functions, particularly, those adapted for mounting on a satellite.

Accordingly, the power distribution type antenna according to the present invention is extremely useful for attaining of space communication and the effective utilization of the satellite orbit and the frequency band for space communication.

For example, the spot beam antenna consisting of the power distribution type antenna according to the present invention is exceedingly preferable for microwave communication from cosmic space to ground, and besides, based on its simple structure and inexpensive manufacture, it is preferable also for the transmitting antenna used for the ultra-large-sized so-called Cyclops system, namely, the project of communicating with the intelligent creatures in the outer cosmos.

On the other hand, the shaped beam antenna, the multibeam antenna, the multi-frequency and multi-polarity multibeam antenna, which comprise the power distribution type antenna according to the present invention, are extremely useful for the establishment of a space communication network for which the stationary satellite orbit and the frequency band allocated to space communication are effectively utilized, and further, the variable multibeam antenna consisting thereof is preferable for installing on any kind of satellite.

In addition, the variable multibeam antenna shown in FIGS. 8 and 9, the primary projector P of which consists of a conventional multi-frequency and multi-polarized antenna employed for the multibeam antenna shown in FIG. 7, facilitates the realization of the multi-frequency and multi-polarity variable multibeam antenna, of course.

Although the invention has been described with a certain degree of particularly, it is understood that the present disclosure has been made only by way of example and that numerous changes in details of construction and the combination and arrangement of parts may be resorted to without departing from the scope of the invention as hereinafter claimed.

What is claimed is:

1. A power distribution antenna comprising:

a primary projector for radiating an electromagnetic wave in a predetermined propagation direction; and a plurality of spaced planar diplexers located in the path of said electromagnetic wave and spaced from said primary projector, a planar surface of each of said diplexers being positioned at a predetermined angle with respect to said propagation direction, each of said diplexers comprising a dielectric base and a lattice shaped metallic film deposited thereon in a predetermined pattern.

2. A power distribution type antenna as claimed in claim 1, further comprising a metallic plate which intersects said electromagnetic wave at a predetermined angle with respect to said propagation direction, said metallic plate being spaced apart from said plurality of planar diplexers.

3. A power distribution type antenna as claimed in claim 1, wherein said lattice shaped metallic film forms lattice windows deposited on said dielectric base, and wherein a plurality of metallic film blocks having a predetermined shape are deposited within said lattice windows.

4. A power distribution type antenna as claimed in claim 1, wherein said primary projector consists of an electromagnetic horn and a parabolic reflector.

5. A power distribution type antenna as claimed in claim 1, wherein said primary projector consists of a plurality of slot antenna arrays mounted closely adjacent to each other.

6. A power distribution type antenna as claimed in claim 2, wherein each of said plurality of planar diplexers and said metallic plate are positioned so as to be directed substantially in the same direction, whereby a spot beam antenna is formed.

7. A power distribution type antenna as claimed in claim 2, wherein each of said plurality of planar diplexers and said metallic plate are positioned so as to be directed substantially in the same direction and the predetermined angle at which each of said plurality of planar diplexers and said metallic plate is positioned is different from the angle at which at least one of the other of said diplexers and metallic plate is positioned, whereby a shaped beam antenna is formed.

8. A power distribution type antenna as claimed in claim 1, wherein the predetermined angle at which each of said plurality of planar diplexers is positioned is different from the angle at which at least one of the other of said diplexers is positioned, whereby a multi-beam antenna is formed.

9. A power distribution type antenna as claimed in claim 2, wherein said primary projector consists of a multi-frequency and multi-polarized projector for radiating an electromagnetic wave having predetermined frequency and polarity components and wherein at least one of said frequency and polarity components of said electromagnetic wave differs from the others, which components are reflected by said plurality of planar diplexers and said metallic plate respectively, whereby a multi-frequency and multi-polarity multibeam antenna is formed.

10. A power distribution type antenna as claimed in claim 1, wherein at least one of said plurality of planar diplexers is mounted on a rotatable mount, whereby a variable multibeam antenna is formed.

11. A power distribution type antenna as claimed in claim 2, wherein at least one of said plurality of planar diplexers is mounted on a rotatable mount, whereby a variable multibeam antenna is formed.

12. A power distribution type antenna as claimed in claim 10, wherein said primary projector consists of a multi-frequency and multi-polarized projector, whereby a multi-frequency and multi-polarity variable multibeam antenna is formed.

13. A power distribution type antenna as claimed in claim 11, wherein said primary projector consists of a multi-frequency and multi-polarized projector, whereby a multi-frequency and multi-polarity variable multibeam antenna is formed.

* * * * *